US005126793A

United States Patent [19]

Taniguchi et al.

[11] Patent Number: 5,126,793

[45] Date of Patent: Jun. 30, 1992

[54] COPYING MACHINE

[75] Inventors: Akihiko Taniguchi, Nara; Kazuhiko Yamakawa, Yamato-Koriyama, both of Japan

[73] Assignee: Sharp Kabushiki Kaisha, Osaka, Japan

[21] Appl. No.: 685,935

[22] Filed: Apr. 16, 1991

[30] Foreign Application Priority Data

Apr. 18, 1990 [JP] Japan ..... 2-104277

[51] Int. Cl.[5] ..... G03G 21/00

[52] U.S. Cl. ..... 355/218; 355/67; 355/69; 355/208

[58] Field of Search ..... 355/203, 204, 208, 218, 355/67, 69, 70; 315/158, 159; 250/205

[56] References Cited

U.S. PATENT DOCUMENTS

| | | | |
|---|---|---|---|
| 3,681,654 | 8/1972 | Quinn | 315/158 X |
| 4,342,906 | 8/1982 | Hyatt | 250/205 |
| 4,344,691 | 8/1982 | Grant et al. . | |
| 4,443,097 | 4/1984 | Nagasawa et al. | 355/68 |
| 4,463,284 | 7/1984 | Tamura et al. | 315/158 |
| 4,464,606 | 8/1984 | Kane | 315/158 |
| 4,467,246 | 8/1984 | Tanaka et al. | 315/158 |
| 4,791,528 | 12/1988 | Suzuki et al. | 355/69 X |
| 4,806,975 | 2/1989 | Godlove et al. | 355/70 X |
| 4,811,047 | 3/1989 | Hosaka et al. | 355/218 X |
| 5,030,887 | 7/1991 | Guisinger | 315/158 |

*Primary Examiner*—A. T. Grimley
*Assistant Examiner*—Matthew S. Smith
*Attorney, Agent, or Firm*—David G. Conlin; Robert F. O'Connell

[57] ABSTRACT

A copying machine having a plurality of blank lamps for removing charges on a non-used area of a photoconductor included in the copy machine for copying an original image includes a unit for generating a PWM signal having a variable pulse width, a unit for converting the PWM signal into a voltage signal based on the pulse width of the PWM signal and supplying the voltage signal, and a unit for controlling turning on and off of the blank lamps based on the voltage signal.

16 Claims, 3 Drawing Sheets

COPYING MACHINE

BACKGROUND OF THE INVENTION

1. Field of the Invention

The present invention relates to a copying machine which provides a control device for controlling the lighting of blank lamps for removing charges from a non-used area of a photoconductor included in the copying machine.

2. Description of the Related Art

The inventors of the present invention know an electrostatic type copying machine which is constructed to, for processing a non-used area of a photoconductor in reduction copying or frame-eliminating copying operation, provide a plurality of blank lamps such as an LED (Light Emitting Diode) lamps between an exposing device and a developing bath and around the photoconductor included in the electrostatic type copying machine so that those blank lamps enable to remove the charges charged on a non-used area, that is, an out-of-image area of the photoconductor.

For the purpose of controlling the blank lamps to be lit on or off, the known electrostatic type copying machine is constructed to take the steps of sending control data from a control unit to a serial-to-parallel converting IC (Integrated Circuit) in a time-sharing manner, converting the control data which are serial data, into parallel data in the serial-to-parallel converting IC, outputting the converted data, that is, the parallel data, and controlling the number of the blank lamps to be lit according to the parallel data. As to one serial-to-parallel converting IC, for example, one 8-bit serial-to-parallel converting IC allows eight blank lamps to be controlled.

The aforementioned known copying machine, however, entails the serial-to-parallel converting IC for converting the serial data sent from the control unit into the parallel data.

The known copying machine also needs a long time for processing the control data, because it has to take the steps of sending the control data for controlling the lighting of the plurality of blank lamps to the serial-to-parallel converting IC in a time sharing manner and converting the serial data into the parallel data.

Moreover, a serial-to-parallel converting unit such as the serial-to-parallel converting IC of the known copying machine is likely to erroneously operate because of the adverse effect resulting from noises of a high-voltage photoconductor or the like.

SUMMARY OF THE INVENTION

It is therefore an object of the present invention to provide a copying machine which is constructed to include blank lamps and control device for the lighting of the blank lamps but exclude a converting unit for converting serial data sent from a control unit into parallel data.

The object of the invention can be achieved by a copying machine having a plurality of blank lamps for removing charges on a non-used area of a photoconductor included in the copy machine for copying an original image including:

means for generating a PWM (Pulse Width Modulation) signal having a variable pulse width;

means for converting the PWM signal into a voltage signal based on the pulse width and supplying the voltage signal; and means for controlling turning on and off of the blank lamps based on the voltage signal.

In operation, in the light of the control data composed of the PWM signal, the copying machine is capable of sending the control data for controlling the lighting of the blank lamps directly, that is, without passing through the serial-to-parallel converting unit. It results in eliminating the time consumed in converting the data, which the aforementioned known copying machine would have consumed. Further, the absence of the serial-to-parallel converting unit results in eliminating the possibility of erroneous operation of the serial-to-parallel converting unit based on the noises caused by the high-voltage photoconductor.

Further objects and advantages of the present invention will be apparent from the following description of the preferred embodiments of the invention as illustrated in the accompanying drawings.

DESCRIPTION OF THE PREFERRED EMBODIMENTS

Figure 1:
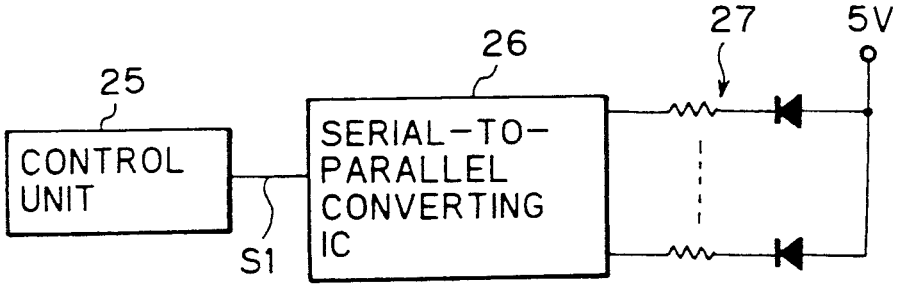
FIG. 1 is a circuit diagram showing known arrangement for selectively lighting blank lamps.

Before describing the present invention, the copying machine known by the inventors of the present invention will be described with reference to FIG. 1.

For the purpose of controlling a lighting of blank lamps for removing charges charged on a photoconductor, the known electrostatic type copying machine provides a control unit 25 and a serial-to-parallel converting IC 26. The control unit 25 serves to send out a serial signal s1 as the data for controlling the lighting of the blank lamps to the serial-to-parallel converting IC 26 in a time-sharing manner. The serial-to-parallel converting IC 26 serves to convert the serial signal s1 into the parallel signal and send out the parallel signal to corresponding lamp driving circuits 27 each composed of a resistor and an LED, resulting in allowing the lamp driving circuits 27 to control the lighting of the blank lamps according to the data of the serial signal s1 sent from the control unit 25.

Hereafter, an embodiment of the present invention will be described with reference to the drawings.

Figure 2:
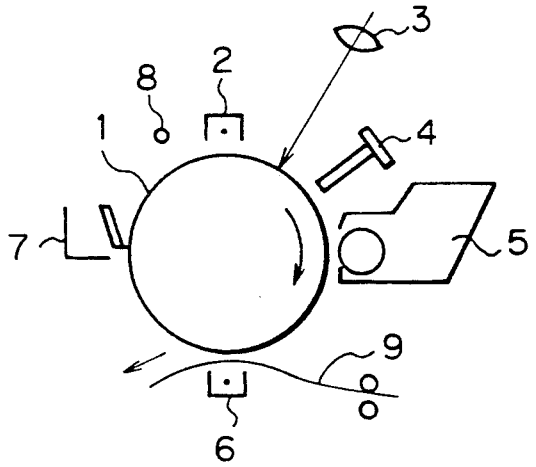
FIG. 2 is a sectional view for describing a copying process executed in an embodiment of the present invention.

At first, a description will be directed to the copying process in the size-reduction copying operation. FIG. 2 is a sectional view showing an essential portion of the copying machine for describing the copying process. As shown in FIG. 2, 1 denotes a photoconductive drum located inside of the copying machine. The photoconductive drum 1 is constructed to be capable of rotating in the direction of an arrow shown in FIG. 2. Around the photoconductive drum 1 are provided a main charger 2, an exposure unit 3, a blank lamp assembly 4 composed of a plurality of blank lamps, a developing unit 5, a transfer charger 6, a cleaning unit 7, and a de-charging lamp 8 for removing charges from the photoconductive drum 1.

In the copying process, the main charger 2 serves to output a negative corona discharge so that it can apply uniform negative charges on the photoconductive drum 1. Next, the exposure unit 3 serves to form an optical image of an original to be copied and reduce a resistance value on the portion of the photoconductive drum 1 to which a ray of light is applied, thereby removing the negative charges of the portion. It results in forming an electrostatic latent image on the surface of the photoconductive drum 1. Then, the blank lamp assembly 4 serves to remove the charges on the non-used area of the photoconductive drum 1, that is, the area where the latent image is not formed in the size-reduction copying operation. The developing unit 5 serves to adhere toner to the electrostatic latent image formed on the surface of the photoconductive drum 1 so that the latent image becomes a visible image. The transfer charger 6 serves to transfer the visible image formed on the photoconductive drum 1 onto a sheet of paper 9 conveyed according to the transfer timing. The image-transferred sheet is conveyed along an arrow shown in FIG. 2 to a fixing unit (not shown) in which it is pressured, heated and fixed. Then, the resulting sheet is ejected to an eject tray (not shown). The cleaning unit 7, on the other hand, serves to remove residual toner on the photoconductive drum 1 and then the de-charger lamp 8 removes residual charges on the photoconductive drum 1 for the purpose of preparing the next copying operation.

In turn, how the blank lamp assembly 4 removes charges from the non-used area, that is, the out-of-image area of the photoconductive drum 1 will be described in detail.

Figure 3:
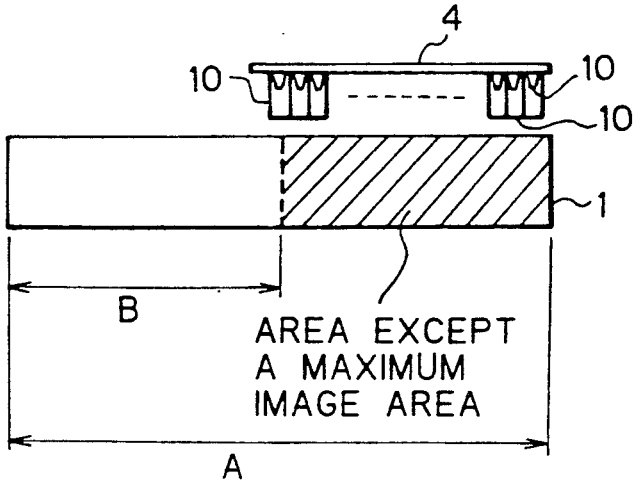
FIG. 3 is a view for explaining how to remove charges from an area except a maximum image area of a photoconductor.

In the copying machine, it is necessary to remove the charges on the non-used area of the photoconductive drum 1 by the blank lamp assembly 4 in the reduction copying or frame-eliminating operation. The one-side type copying machine is required to remove only the charges on an area except a maximum image area of the photoconductive drum 1 as shown in FIG. 3. The area except a maximum image area is a result of subtracting a maximum copy-able image area B from a drum width A of the photoconductive drum 1. The blank lamp assembly 4 which includes a plurality of blank lamps 10 is located in opposition to the photoconductive drum 1 so that the blank lamps 10 enable to apply a ray of light to the area except the maximum image area for removing the charges on that area. Each of the blank lamps 10 may employ an LED, for example. The number of the blank lamps 10 to be located is defined depending on the function required by the copying machine. For example, the commonly available copying machine according to an embodiment of the present invention requires ten blank lamps, which are ranged at regular pitches.

The description will be directed to how the lighting of the blank lamps 10 are controlled.

Figure 5:
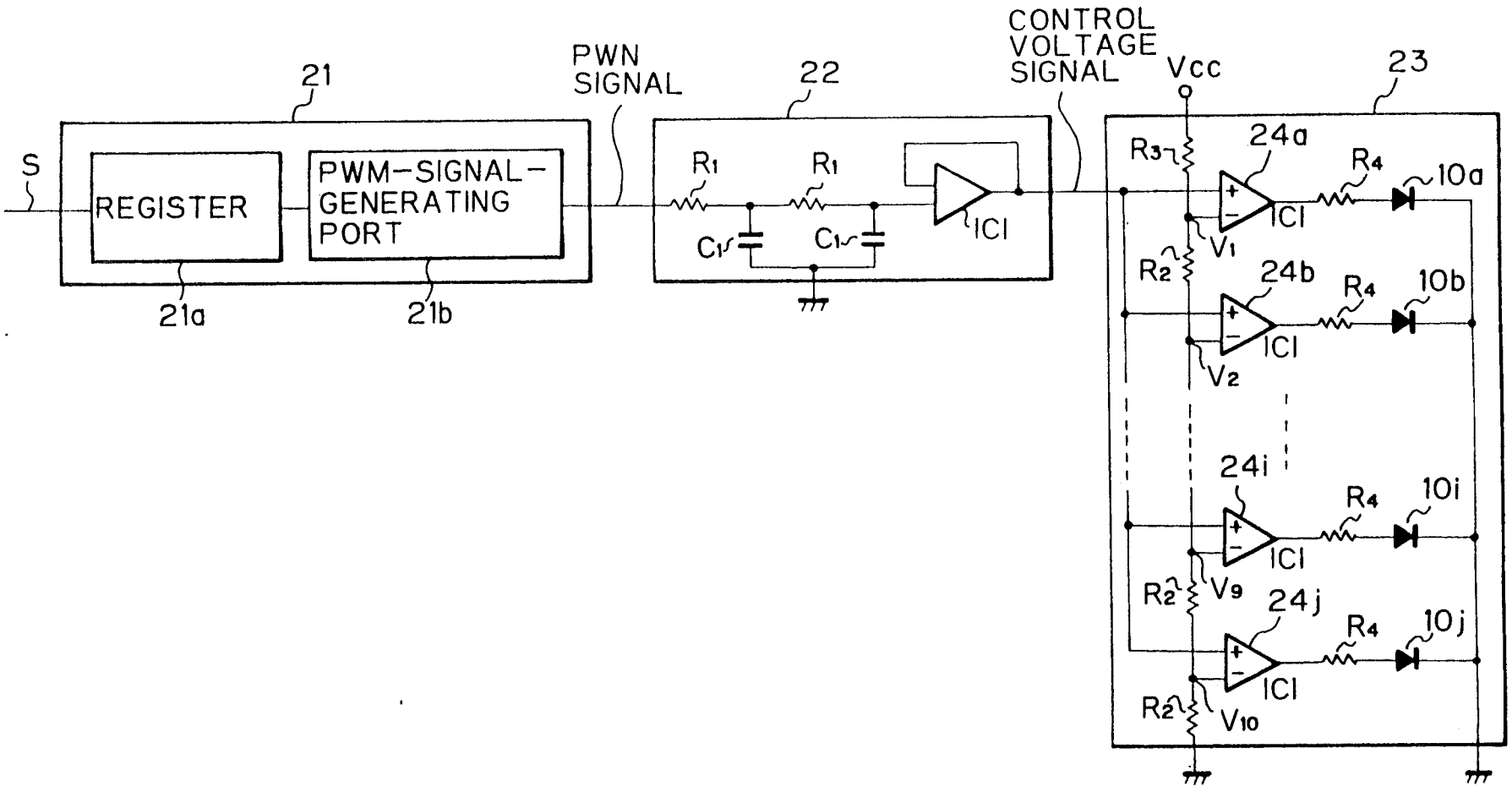
FIG. 5 is a block diagram showing a circuit for selectively lighting blank lamps according to the embodiment of the present invention.

As shown in FIG. 5, a control device for controlling the lighting of blank lamps 10*a* to 10*j* for removing charges from a non-used area of the photoconductor drum includes a control unit 21, an integrating circuit 22 and a lamp driving circuit 23.

The ten blank lamps 10 are respectively controlled to be lit on and off in response to a control signal generated in the control unit 21. The control signal is composed of a PWM signal, that is, a pulse-width modulating signal. The PWM signal width is divided into several portions. For example, if the ten blank lamps are used, the PWM signal width should be divided into ten stages. In detail, for setting the ten stages corresponding to the PWM signal widths, signal s corresponding to each of ten pulse widths is input into at least one register 21*a* included in the control unit 21 and then the PWM signal is output at a PWM-signal-generating port 21*b* included in the control unit 21.

The integrating circuit 22 includes resisters R1, capacitors C1 and an amplifier. The control unit 21 serves to send the PWM signal to the integrating circuit 22 in which the PWM signal is converted into a voltage signal linearly changing on the set pulse width. And, the linearly changing voltage signal is input into the lamp driving circuit 23. Depending on the voltage signal, the number of the blank lamps 10*a* to 10*j* to be lit is defined.

Figure 6:
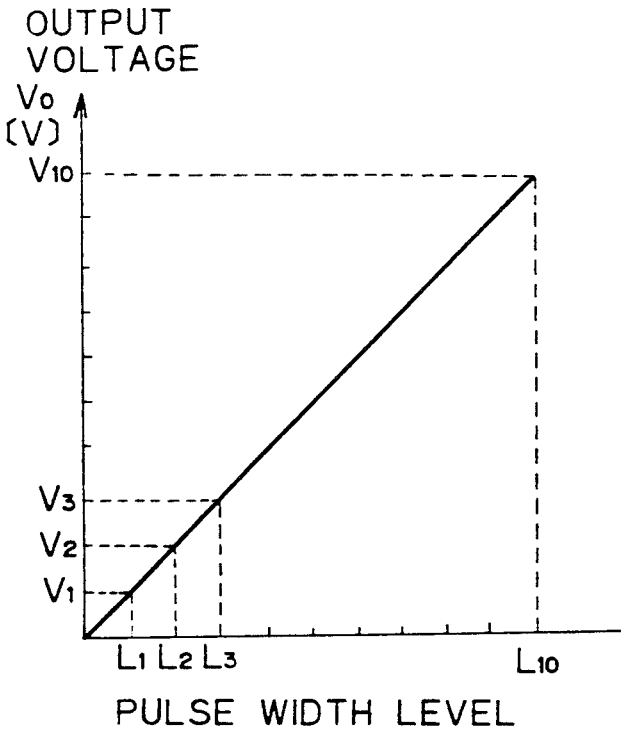
FIG. 6 is a chart showing a relation between a pulse width level of the PWM signal and an output voltage.

The lamp driving circuit 23 has ten lamp driving units each connected in parallel. Each of ten lamp driving units is composed of each of comparison amplifiers 24*a* to 24*j* and each of the blank lamps 10*a* to 10*j* connected in series, respectively. To positive terminals of the comparison amplifiers 24*a* to 24*j* are respectively applied control voltage signals converted through the integrating circuit 22. To negative terminals of the comparison amplifiers 24*a* to 24*j* are respectively applied reference voltages, which are derived on the basis of the relation between a pulse width of the PWM signal (replaced with a duty ratio) and an output voltage $V_0$. That is, the reference voltage can be obtained by resistance-dividing the power voltage according to the voltage levels (V1 to V10), as shown in FIG. 6, which are necessary for lighting one to ten blank lamps 10*a* to 10*j*.

Figure 4:
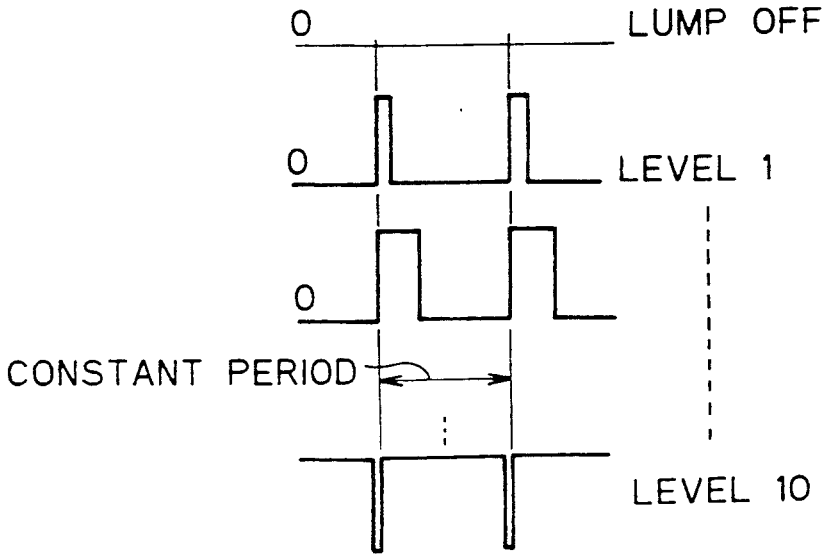
FIG. 4 is an explanatory view showing a pulse width level of a PWM signal.

In the same-size copying operation, no PWM signal is generated, so that no blank lamps 10 are lit on. For example, in case of outputting a level 1 of the PWM signal which is a minimum pulse width in a constant period as shown in FIG. 4, as shown in FIG. 6, the lamp driving circuit 23 receives a voltage of V1 so that only the blank lamp 10*a* is lit. The blank lamps 10*b* to 10*j* to be lit are increased according to the pulse width levels of the PWM signal. For example, in the size-reduction copying from a sheet of DINE size A3 to a sheet of DINE size A4, the reduction factor is 70% (area ratio is 50%), and the pulse width of the PWM signal matches to a maximum level 10. Hence, the lamp driving circuit 23 receives a voltage V10 so that the ten blank lamps 10*a* to 10*j* are all lit up.

As described above, the present embodiment is constructed to control the lighting of the blank lamps in response to the PWM signal, resulting in reducing the burden given to the control unit (including a CPU (Central Processing Unit)) and lowering the cost. Further, the absence of the serial-to-parallel converting circuit prevents the embodiment from being erroneously operated based on a spark noise or the like resulting from several high-voltage units included in the copying machine, because the serial-to-parallel converting circuit is likely to operate improperly in response to the noises caused by the high-voltage units.

The present embodiment has been described with respect to the widely available copying machine providing about ten blank lamps. However, it goes without saying that the present invention may apply to a middle- or high-level copying machine providing more blank lamps.

Further, the present embodiment is constructed to control the lighting of the blank lamps in response to the PWM signal. The present invention, however, may apply to the copying machine providing a zooming optical system. In this case, a lens included in the zooming optical system is zoomed according to a magnification. Hence, the embodiment for such a copying machine provides a variable resistor so that the voltage is allowed to change depending on the zooming of the lens. This embodiment takes the steps of inputting the changing voltage to the comparison amplifier, comparing the voltage with reference voltages, and controlling the lighting of the blank lamps according to the compared result. This method makes it possible to achieve the object of the present invention.

Many widely different embodiments of the present invention may be constructed without departing from the spirit and scope of the present invention. It should be understood that the present invention is not limited to the specific embodiments described in the specification, except as defined in the appended claims.

What is claimed is:

1. A copying machine having a plurality of blank lamps for removing charges on a non-used area of a photoconductor included in said copy machine for copying an original image comprising:

means for generating a PWM signal having a variable pulse width:

means for converting said PWM signal into a voltage signal based on said pulse width; and means for controlling the turning on and off of said blank lamps based on said voltage signal sent from said converting means, said controlling means including a lamp driving circuit having comparison amplifiers connected in series to said blank lamps respectively, each of said comparison amplifiers having a positive terminal for receiving said voltage signal sent from said converting means and a negative terminal for receiving a reference voltage derived on a relation between said pulse width of said PWM signal and said reference voltage.

2. A copying machine according to claim 1, wherein said means for generating said PWM signal includes at least one register and a PWM-signal-generating port.

3. A copying machine according to claim 1, wherein said photoconductor is formed by a photoconductive drum, and wherein said blank lamps are arranged in alignment along a rotational axis of said photoconductive drum.

4. A copying machine according to claim 1, wherein said means for converting said PWM signal into said voltage signal based on said pulse width includes means for converting said PWM signal into a linearly-changing voltage signal.

5. A copying machine according to claim 1, wherein said means for controlling the turning on and off of said blank lamps based on said voltage signal includes means for controlling the number of said blank lamps to be turned on and off based on said voltage signal.

6. A copying machine having a plurality of blank lamps for removing charges on a non-used area of a photoconductor included in said copy machine for copying an original image comprising:

means for generating a PWM signal having a variable pulse width, said means for generating said PWM signal including a least one register and a PWM-signal-generating port;

means for converting said PWM signal into a voltage signal based on said pulse width; and means for controlling the turning on and off of said blank lamps based on said voltage signal sent from said converting means.

7. A copying machine according to claim 6 wherein said controlling means includes a lamp driving circuit having comparison amplifiers connected in series to said blank lamps respectively, each of said comparison amplifiers having a positive terminal for receiving said voltage signal sent form said converting means and a negative terminal for receiving a reference voltage derived on a relation between said pulse width of said PWM signal and said reference voltage.

8. A copying machine according to claim 7, wherein said means for converting said PWM signal into said voltage signal based on said pulse width includes means for converting said PWM signal into a linearly-changing voltage signal.

9. A copying machine according to claim 7, wherein said means for controlling the turning on and off of said blank lamps based on said voltage signal includes means for controlling the number of said blank lamps to be turned on and off based on said voltage signal.

10. A copying machine according to claim 6, wherein said photoconductor is formed by a photoconductive drum, and wherein said blank lamps are arranged in alignment along a rotational axis of said photoconductive drum.

11. A copying machine having a plurality of blank lamps for removing charges on a non-used area of a photoconductor included in said copy machine for copying an original image comprising:

means for generating a PWM signal having a variable pulse width;

means for converting said PWM signal into a voltage signal based on said pulse width; and means for controlling turning on and off of said blank lamps based on said voltage signal sent from said converting means, said controlling means including a lamp driving circuit having comparison amplifiers connected in series to said blank lamps respectively.

12. A copying machine according to claim 11, wherein each of said comparison amplifiers includes a positive terminal for receiving said voltage signals sent from said converting means and a negative terminal for receiving a reference voltage derived in a relation between said pulse width of said PWM signal and said reference voltage.

13. A copying machine according to claim 11, wherein said means for generating said PWM signal includes at least one register and a PWM-signal-generating port.

14. A copying machine according to claim 13, wherein said means for converting said PWM signal into said voltage signal based on said pulse width includes means for converting said PWM signal into a linearly-changing voltage signal.

15. A copying machine according to claim 12, wherein said means for controlling turning on and off of said blank lamps based on said voltage signal includes means for controlling the number of said blank lamps to be turned on and off based on said voltage signal.

16. A copying machine according to claim 11, wherein said photoconductor is formed by a photoconductive drum, and wherein said blank lamps are arranged in alignment along a rotational axis of said photoconductive drum.

* * * * *